United States Patent [19]

Nakamura

[11] Patent Number: 4,597,815

[45] Date of Patent: Jul. 1, 1986

[54] TRANSFER PRINTING

[75] Inventor: Yuzo Nakamura, Muko, Japan

[73] Assignee: Nissha Printing Co., Ltd., Kyoto, Japan

[21] Appl. No.: 325,054

[22] Filed: Nov. 25, 1981

[30] Foreign Application Priority Data

| | | | |
|---|---|---|---|
| Nov. 29, 1980 | [JP] | Japan | 55-168241 |
| Feb. 10, 1981 | [JP] | Japan | 56-18658 |
| Apr. 16, 1981 | [JP] | Japan | 56-57705 |
| May 20, 1981 | [JP] | Japan | 56-73976[U] |
| May 22, 1981 | [JP] | Japan | 56-75094[U] |

[51] Int. Cl.[4] ..... B41M 3/12; B41M 5/26; B44C 1/16

[52] U.S. Cl. ..... 156/235; 156/234; 156/240; 156/249; 427/148; 428/200; 428/210; 428/484; 428/913; 428/914

[58] Field of Search ..... 156/234, 235, 239, 240, 156/249, 277; 427/148; 428/200, 913, 914, 210, 484, 488.1, 488.4

[56] References Cited

U.S. PATENT DOCUMENTS

| | | | |
|---|---|---|---|
| 2,970,076 | 1/1961 | Porth | 156/240 |
| 3,445,309 | 5/1969 | Milliken | 156/240 |
| 3,565,713 | 2/1971 | Wagner | 156/240 |
| 3,887,420 | 6/1975 | Weingrad | 156/235 |
| 4,012,552 | 3/1977 | Watts | 428/204 |
| 4,171,398 | 10/1979 | Hunt | 428/207 |

*Primary Examiner*—Bruce H. Hess

*Attorney, Agent, or Firm*—Fidelman, Wolffe & Waldron

[57] ABSTRACT

A transfer material comprising a substrate, a layer of thermoplastic material formed on said substrate and a design layer formed on said thermoplastic layer, said thermoplastic material being heat-sensitive and having such a characteristic that it is not tacky at room temperature but activated by heating to become tacky and remain so for a predetermined period of time after said heating is terminated. The transfer material may include another layer of wax-like material interposed between the thermoplastic layer and the substrate. A method and an apparatus for coloring an article by using the transfer material are also provided.

11 Claims, 20 Drawing Figures

TRANSFER PRINTING

BACKGROUND OF THE INVENTION

This invention relates to transfer printing and more particularly to a transfer material and a method of coloring the surface of an article by using the transfer material, as well as an apparatus suitable for use in carrying out the method.

Transfer printing by the use of a transfer head or pad has been widely used for printing a design on the surface of an object. U.S. Pat. No. 3,967,021 discloses a transfer printing method which employs a transfer material comprising a design layer including the design to be transfer-printed, a pair of adhesive layers between which the design layer is laminated, and a substrate layer supporting the three laminated layers. The two adhesive layers are heat-sensitive and activatable within different temperature ranges.

When the design is to be transferred to the transfer pad, the transfer material is heated to a temperature within one of the two temperature ranges so that one of the adhesive layers is activated to cause the design layer to be transferred to the transfer pad, and when the design layer is to be transferred from the pad to an article to be transfer-printed, the temperature drops within the other of the temperature ranges so that the other of said adhesive layers is activated to cause the design layer to be transferred from the pad surface to the surface of the article.

To carry out the above method it is necessary that the two steps should be conducted either in two different chambers the temperatures inside which are maintained within the above-mentioned respective ranges, or separately at a certain time interval, that is, first at a first temperature within one of the two temperature ranges and after a time interval at a different temperature within the other of the temperature ranges.

In either case, the process is time-consuming and not suitable for mass production. Moreover, since the article is heated in the process, it must be heat-resistive such as ceramics.

In order to overcome the above-mentioned disadvantages there was proposed in Japanese Patent Application No. 54-103653 a transfer printing method in which a transfer material comprising a layer of wax and a design layer of heat-sensitive adhesive ink is used so that the design layer is transferred by a transfer material to the surface of an article to be printed. Since the heat-sensitive ink remains active only while it is being heated, it is necessary that the article should be kept heated when transfer printing is conducted. This requires much time and labor.

Accordingly, it is one object of the invention to provide a transfer material which is suitable for use in transfer printing a colored design on articles made of various kinds of materials.

Another object of the invention is to provide such a transfer material as aforesaid which enables a simpler and easier method of coloring the surface of an article than if known transfer materials are used.

Another object of the invention is to provide a method of producing a colored design on the differently contoured surfaces of articles made of different kinds of materials by using the transfer material of the invention.

The technique of transfer printing is in wide use for coloring ceramic ware. Broadly, there are known three methods of coloring ceramic ware. One method (I) involves applying glaze on the surface of unglazed ceramic ware, firing the ware at about 1300° C., transfer printing a colored design on the glazed surface of the ware and again firing the ware at about 800° C. to 1200° C. Another method (II) involves transfer printing a colored design on the surface of unglazed ceramic ware, firing the transfer-printed ware at about 500° C. to 700° C., applying glaze on the colored surface of the ware and then firing the ware at about 1300° C. A third method (III) involves applying a mixture of glaze and a synthetic resin or resins on the surface of unglazed ceramic ware, transfer printing a colored design on the applied layer of the mixture, and then firing the ware at about 1300° C.

The method of transfer printing disclosed in Japanese Patent Application No. 54-103653 above referred to can be used in either of the above-mentioned three methods of coloring ceramic ware. With this method of transfer printing, however, the ceramic ware must be heated prior to the step of transfer printing and kept at the required elevated temperature when the colored design is transferred from the transfer material to the surface of the ceramic ware. This requires much time and labor. Moreover, methods I and II require a heating step in addition to the above-mentioned firing steps, with resulting increase in the energy cost.

Another object of this invention is therefore to provide a method of producing a colored design on the surface of ceramic ware by using the transfer material of the invention.

Another object of the invention is to provide such a method as mentioned above which enables production of a multi-colored design on the surface of ceramic ware without loss of details or fidelity of the design and without requiring much time and labor and at a low energy cost.

An additional object of the invention is to provide a machine suitable for carrying out the method of the invention.

The invention will be described in detail with reference to the accompanying drawing.

SUMMARY OF THE INVENTION

Briefly stated, in accordance with the invention there is provided a transfer material which comprises a substrate, a layer of thermoplastic material formed on the substrate, and a design layer formed on the thermoplastic layer. The thermoplastic material is heat-sensitive and has such a characteristic that it is not tacky at room temperature but activated upon heating to become tacky and remain so for a predetermined period of time after the heating is terminated and then solidifies to effect complete adhesion upon lapse of the predetermined period of time.

There is also provided a method of coloring the surface of an article which comprises the steps of providing a sheet of transfer material of the invention, heating the sheet to a temperature at which the thermoplastic layer of the sheet becomes tacky, and transferring the design layer and the thermoplastic layer from the sheet to the surface of the article. If the article is of a heat-resistive material, the method may include an additional step of heating the article so that the thermoplastic material is decomposed and removed from the surface of the article.

There is further provided an apparatus for coloring the surface of an article by transfer printing which comprises means for heating a sheet of transfer material of the invention, means for selectively placing the sheet of transfer material on the heating means and removing the sheet from the heating means, a transfer pad for receiving on the surface thereof the design layer from the sheet and releasing the design layer from the pad surface, and means for moving the transfer pad so as to bring the pad surface into contact with the sheet of transfer material on the heating means for transfer of the design layer from the sheet to the pad surface and subsequently bring the pad surface into contact with the surface of an article for transfer of the design layer from the pad surface to the surface of the article.

DESCRIPTION OF PREFERRED EMBODIMENTS

Figure 1A:
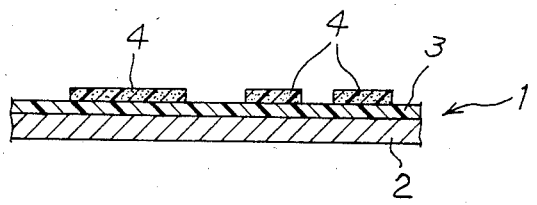
FIGS. 1*a*, 1*b*, 2 and 3 are schematic cross-sectional views of different forms of the transfer material of the invention.

Referring to FIG. 1*a*, a transfer material 1 is schematically shown in cross section and comprises a substrate 2, a thermoplastic layer 3 formed on the sheet 2 and a design layer 4 formed on the layer 3.

The substrate 2 can be a sheet of paper of suitable quality such as coated paper, kraft paper, or a film of a suitable resinous material such as polyethylene terephthalate or the like resinous material.

The thermoplastic material of the layer 3 is potentially adhesive and heat-activatable to a state of continuous tackiness. In other words, the material of the thermoplastic layer 3 has such a characteristic that it is not tacky or adhesive at room temperature but activated by heating to a state of tackiness, which continues for a substantial period of time even after the application of heat is terminated, and solidifies with a required degree of adhesion. The material of the thermoplastic layer 3 may be referred to as an adhesive of the delay-tack type. The material preferably is decomposable when it is fired or burned.

The thermoplastic material is a wax-like mixture of wax, oil and synthetic resin. Examples of the wax are metalized synthesized wax, oxidized modified wax, paraffin wax, animal wax and plant wax, which may be used either individually or in mixture. Examples of the oil are mineral oils, animal oils and plant oils, which may be used either individually or in mixture. Examples of the resin are thermoplastic hydrocarbon resins and ethylene copolymers, which may also be used either individually or in mixture.

Alternatively, the thermoplastic material of the layer 3 may be composed of one or a mixture of two or more of thermoplastic latexes such as styrene-butadiene latex and nitrile-butadiene rubber latex; copolymer emulsions of thermoplastic resins such as alkyd emulsion, acryl-ester copolymer emulsion; ethylene-vinylacetate copolymer emulsion; acryl emulsion, and vinylchloride copolymer emulsion; hydrocarbon resin emulsion; and rosin emulsion.

Figure 2:
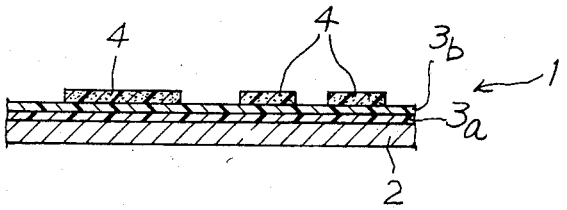

The thermoplastic layer 3 may be formed by applying one or a mixture of two or more of the above-mentioned materials in any known suitable manner. The layer 3 may comprise either a single layer as shown in FIG. 1 or two layers 3*a* and 3*b* as shown in FIG. 2. In the latter case, the lower layer 3*a* may comprise one or a mixture of the above-mentioned waxes, oils, resins, latexes, and emulsions, while the upper layer 3*b* comprises one or a mixture of the above-mentioned materials so that the material of the upper layer 3*b* may have a different softening point and a different melting point than that of the lower layer 3*a*.

Alternatively, the lower layer 3*a* may be formed of wax without adhesivity while the upper layer 3*b* is formed of an adhesive material having the above-mentioned characteristic.

The dual-layer arrangement enables smooth separation of the thermoplastic layer from the substrate and subsequent proper adhesive application of the layer to the surface of an article to be transfer-printed.

The design layer 4 may be formed by off-set, gravure, silk screen or any other suitable printing techniques with an ink commonly used for printing and containing colorants, a binder, and other necessary component elements.

Figure 3:
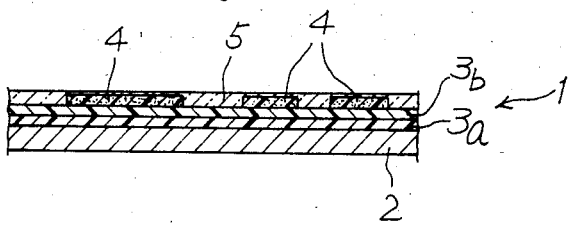
Figure 1B:
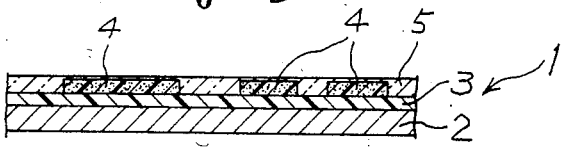

If necessary, an additional layer 5 of an elastomeric material such as urethane resin may be formed on or beneath the design layer 4 as shown in FIGS. 1*b* and 3 to prevent distortion of the design layer 4 when transfer printing is conducted. If the design is delicate and complex, the protective layer 5 is particularly useful to maintain the original design in the course of transfer printing.

Referring now to FIGS. 4*a* to 4*f*, the method of the invention will now be explained. First, a sheet 1 of the transfer material as prepared in the above-mentioned manner is provided. The sheet is then heated to a temperature of 80° C. to 200° C. depending upon the composition of the thermoplastic layer 3 of the transfer material, so that the thermoplastic layer 3 is softened and becomes tacky. If the layer 3 is of the dual-layer construction in which the lower layer 3*a* comprises wax while the upper layer 3*b* comprises adhesive, the wax is softened and the adhesive is activated.

Figure 4A:
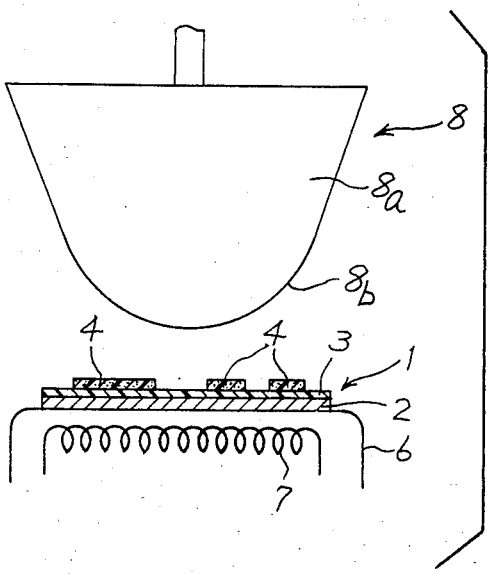
FIGS. 4*a* through 4*f* are schematic cross-sectional views for explanation of one method of transfer printing of the invention.
Figure 4B:
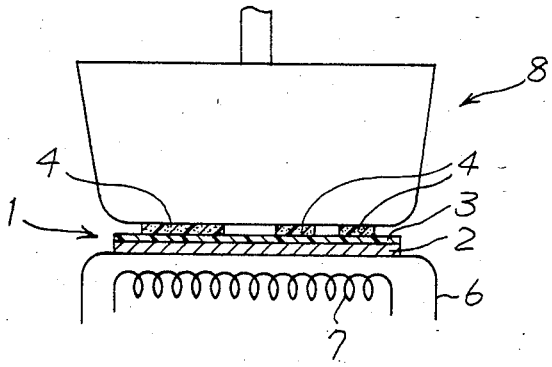
Figure 4C:
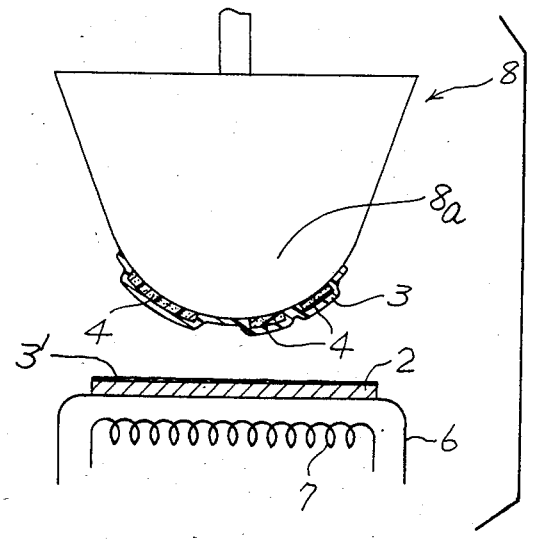

Any suitable device may be used for heating the sheet. A table 6 provided with an electric heater 7 may advantageously be used for the purpose, since the next step of the process can immediately be taken on the heated sheet 1 on the table 6. A transfer head 8 is provided with a pad 8*a* made of a suitable resiliently deformable material such as silicone rubber and so contoured so as to have a convexly curved surface 8*b*. The head 8 is brought downwardly into contact with the upper surface of the heated sheet 1 of transfer material with a suitable pressure as shown in FIG. 4*b*, so that as the head 8 is raised, most of the thermoplastic layer 3 together with the design layer 4 and, if provided, the coating layer 5 are transferred to the surface of the pad 8*a* as shown in FIG. 4*c*. Some of the thermoplastic material is left on the substrate as shown at 3'.

Figure 4D:
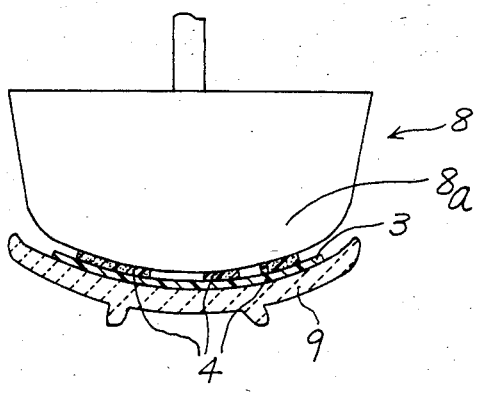
Figure 4E:
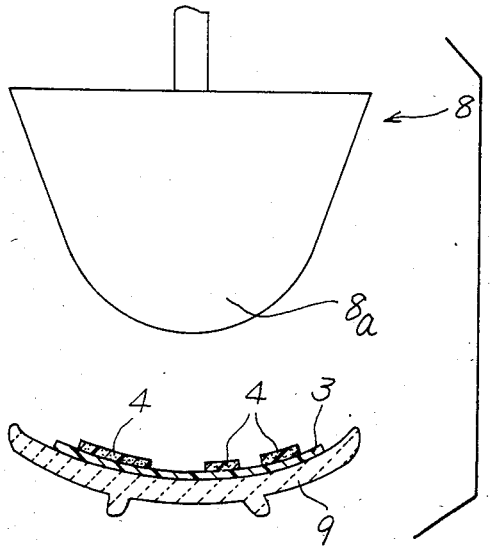

At the next step, the transfer head 8 with the design and other layers on the surface of the pad 8*a* is brought into contact with the surface of an article 9 to be colored or transfer-printed with a suitable contact pressure as shown in FIG. 4*d*, so that as the head 8 is raised again, the design layer 4 and the adhesive layer 3 are transferred from the pad surface to the surface of the article as shown in FIG. 4*e*.

As can be seen from the above, when the design layer 4 and the thermoplastic layer 3 of the transfer material are transferred from the substrate 2 thereof to the pad surface 8*b* of the transfer head 8, these layers 3 and 4 adhere more strongly to the pad surface 8*b* than to the substrate 2, and when the layers are transferred from the pad surface to the surface of the article 9, they adhere more strongly to the surface of the article than to the pad surface. This is possible by proper selection of the materials of the substrate and the thermoplastic layer of the transfer material as well as the material of the object to be transfer-printed, and by the state of continuous tackiness of the activated thermoplastic or adhesive layer.

At the next step of the process, the article 9 with the transferred layers on the surface thereof is left for a period of time, for example, 1 (one) to 50 hours for the thermoplastic material to solidify to effect complete and permanent bondage between the design layer 4 and the surface of the article 9.

Figure 4F:
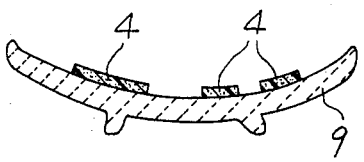

If necessary and if the article is of a heat-resistive material such as ceramic or metal, the process may further include an additional step of heating the article with the transferred layers 3 and 4 thereon to such a temperature as to securely fix the design layer to the surface of the article while simultaneously decomposing the thermoplastic material 3 and the binder in the design layer 4 and removing the burned remnants from the surface of the article, so that the surface becomes clean with the design clearly transfer-printed thereon as shown in FIG. 4*f*.

Figure 5A:
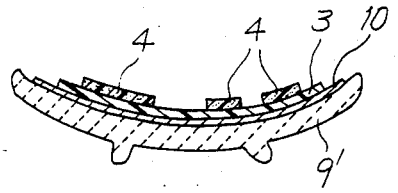
FIGS. 5*a* and 5*b* are schematic cross-sectional views for explanation of another method of transfer printing of the invention.

If the article to be treated is a piece of unglazed ceramic ware 9', the surface of the ceramic ware is coated with a layer 10 of glaze containing a solidifying agent, as shown in FIG. 5*a*. The ware surface may be coated first with glaze and then a solidifying agent over the glaze layer, or a mixture of glaze and a solidifying agent may be applied to the ware surface.

The glaze can be any of the commonly used types and examples of the solidifying agent are starch, cellulose, acrylic or vinyl resin, or a mixture of one or more of these resins and one or more of polyoxyethylene oxide, carragenan, guargum, and the like. A solidifying agent commercially available under the tradenames of JCT-800 and JCT-70 from JCT Co., Nagoya, Japan may also be used either individually or in mixture.

Figure 5B:
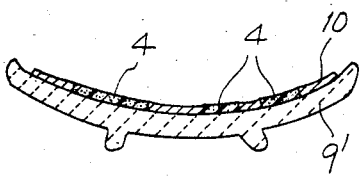

The transfer head with the design layer and the thermoplastic layer on the pad surface thereof is pressed against the applied layer of the glaze containing a solidifying agent formed on the surface of the unglazed ceramic ware, so that the design layer and the thermoplastic layer are transferred from the pad to the applied glaze layer of the ware (FIG. 5*a*). Then the ware is fired at about 1300° C. so that the glaze and the ink of the design layer together with the ceramic of the ware are sintered to effect solid formation of the design on the glazed ceramic ware. If the thermoplastic material is thermally decomposable, the firing dissipates the thermoplastic material, leaving the design layer embedded in the sintered glaze as shown in FIG. 5*b* thereby to improve the coloring quality of the finished product.

In the above-described examples of the method of the invention, the transfer material is heated to enable separation of the design layer 4 and the thermoplastic layer 3 from the substrate of the transfer material and simultaneous activation of the thermoplastic material 3 to continuous tackiness. The transfer head 8 may be heated for the same purpose instead of or in addition to the heating of the transfer material.

Some preferred embodiments of the invention will now be given below for better understanding of the invention.

EXAMPLE I

Coated paper weighing 128 g per square meter is used as the substrate, on which a thermoplastic layer is formed with a mixture of the following composition:

| | Parts by weight |
|---|---|
| Hydrocarbon resin (Arukon, product of Arakawa Chemical Co., Osaka, Japan) | 30 |
| Paraffin wax | 20 |
| Oxidized modified wax (KPE, product of Hoechst, Co., West Germany) | 20 |
| Wax copolymerized with ethylene | 10 |
| White oil | 10 |
| Bees wax | 10 |

On the surface of the thermoplastic layer a design layer is formed by screen printing with an ink used for coloring ceramic ware. The ink contains inorganic pigments and a binder in an amount equal to or half the amount of the pigments. Then a coating layer is formed on the design layer by screen printing to obtain a sheet of transfer material.

On the other hand, a glaze of the following composition is prepared and applied to the surface of a piece of unglazed ceramic ware.

| | |
|---|---|
| Glaze for coloring with no bittern added (48° Be) | 51% |
| JCT-800 (Product of JCT Co., Nagoya, Japan) | 1% |
| JCT-70 (Product of JCT Co.) | 1% |
| Water | 47% |

The sheet of transfer material is heated on a heating plate to about 130° C., and a silicone rubber pad the surface of which is heated to about 80° C. is pressed against the design layer of the heated sheet of transfer material so that the design layer and most of the thermoplastic layer are transferred to the surface of the pad.

The pad is then pressed against the glaze-coated surface of the ceramic ware, so that the design layer and the thermoplastic layer are transferred to the surface of the ware without any distortion of the design. The ware is then fired at 1250° C. The design has been beautifully and securely transfer-printed to the glazed surface of the ceramic ware.

EXAMPLE II

Coated paper weighing 128 g per square meter is used as the substrate sheet, on which a first and a second thermoplastic layer are successively formed one upon the other with a mixture of each of the following compositions.

Composition of the first thermoplastic layer:

| | Parts by weight |
|---|---|
| Hydrocarbon resin (Arukon, product of Arakawa Chemical Co., Osaka, Japan) | 38 |
| Metalized synthesized wax (Caw-20, product of Hoechst Co.) | 8 |
| Oxidized modified wax (KPE, product of Hoechst Co.) | 12 |
| Oxidized modified wax (R-21, product of Hoechst Co.) | 4 |
| Wax copolymerized with ethylene | 8 |
| Bees wax | 4 |
| Paraffin wax | 16 |
| White oil | 10 |

Composition of the second thermoplastic layer:

| | |
|---|---|
| Hydrocarbon resin (Arukon) | 16 |
| Oxidized modified wax (KPE) | 16 |
| Wax copolymerized with ethylene | 12 |
| Castor wax | 8 |
| Bees wax | 8 |
| Paraffin wax | 24 |
| White oil | 16 |

On the surface of the second thermoplastic layer thus formed a design layer is formed by the gravure process with an ink commonly used for coloring ceramic ware and containing inorganic pigments as chief components to produce a sheet of transfer material.

On the other hand, a glaze of the following composition is prepared and mixed with about 10% by weight of a solidifying agent, and the mixture is applied on the unglazed surface of a piece of ceramic ware.

Composition of glaze:

| | |
|---|---|
| Feldspar | 42.10% |
| Limestone | 17.64% |
| Kaolin | 13.06% |
| Quartz | 27.20% |

Composition of the solidifying agent:

| | |
|---|---|
| Hydroxyethyl cellulose | 8.00% |
| Polyoxyethylene oxide | 1.20% |
| Water | 90.80% |

The sheet of transfer material is heated on a heating plate to about 130° C., and a transfer head with a silicone rubber pad is pressed against the design layer of the heated sheet of transfer material so that the design layer and most of the thermoplastic layers are transferred to the pad surface of the transfer head.

The head is then pressed against the glaze-coated surface of the unglazed ceramic ware so that the design layer and the thermoplastic layers are transferred from the pad surface to the glaze-coated surface of the ceramic ware, which is then fired at 1350° C. The ware has now been glazed, with the design having been clearly and securely transfer-printed on the surface thereof.

EXAMPLE III

A sheet of transfer material is prepared in the same manner as in Example II. A piece of unglazed ceramic ware has its surface coated first with a glaze of the following composition and then with a solidifying agent of the following composition.

Composition of glaze:

| | |
|---|---|
| Feldspar | 45% |
| Limestone | 10% |
| Silica | 16% |
| Kaolin | 7% |
| Barium carbonate | 9% |
| Zirconium silicate | 10% |
| Red iron oxide | 3% |

Composition of the solidifying agent:

| | |
|---|---|
| Primal AC-33 (product of Japan Akuriru Co., Tokyo, Japan) | 15% |
| Water | 85% |

After the coated surface of the ceramic ware is dried, transfer printing is conducted on the coated surface by using the transfer material, after which the ware is fired at 1200° C. A stone ware with the design beautifully and securely transfer-printed thereon has been obtained.

Figure 6A:
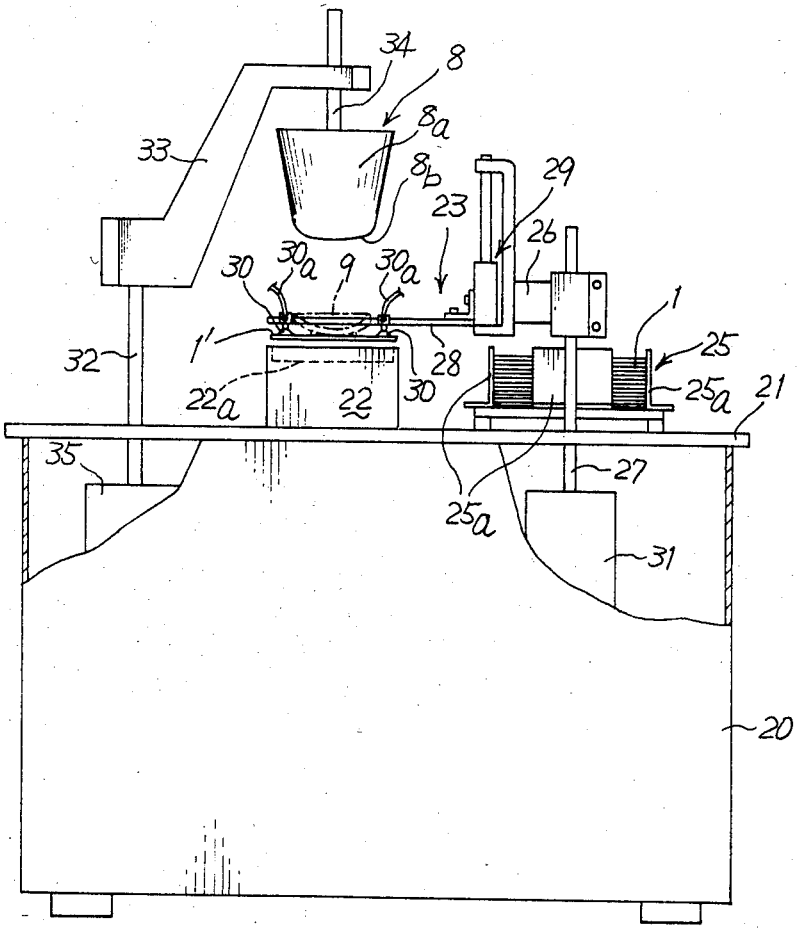
FIG. 6*a* is a partly cut-away elevational view of a transfer printing machine constructed in accordance with the invention.
Figure 6B:
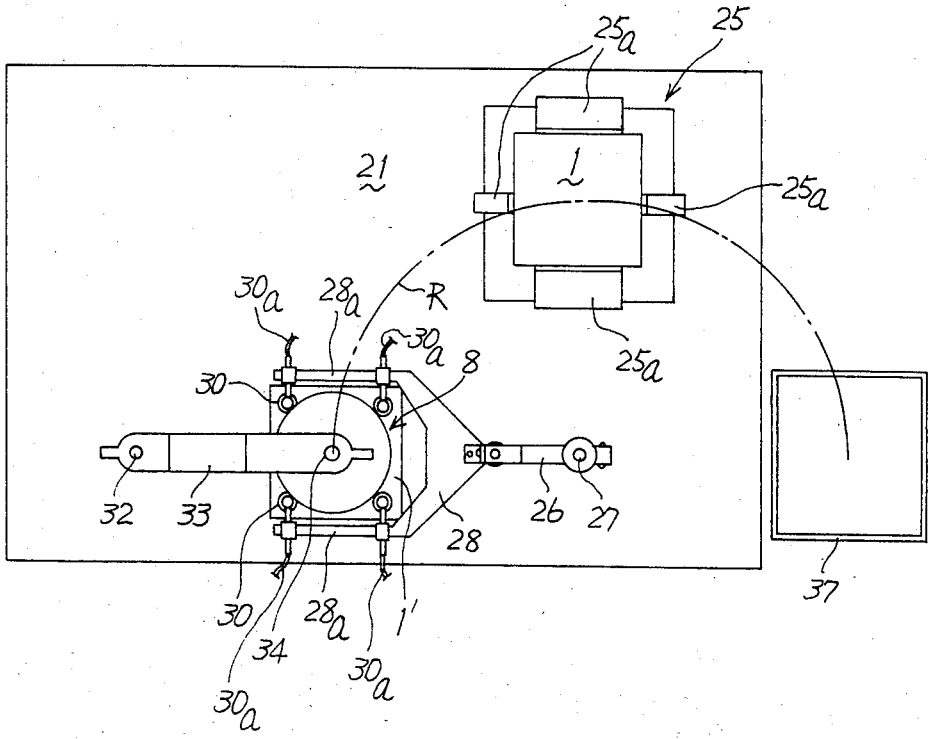
FIG. 6*b* is a top plan view of FIG. 6*a;*

Referring to FIGS. 6*a* to 6*b*, a machine suitable for use in carrying out the method of the invention will now be described.

There is somewhat schematically shown a housing 20 in which various components parts such as a motor, air cylinders, and associated mechanisms and parts, etc. are enclosed although most of them are not shown for simplicity of illustration. The housing 20 has a flat top wall 21, on which a heating device 22, a sheet holder 23, a transfer head 8 and a sheet stocker 25 are provided.

The heating device 22 has on top thereof a heating plate 22*a* on which a sheet of transfer material 1' is placed so as to be heated by a heater not shown but enclosed in the device 22.

The sheet holder 23 comprises a bracket 26 mounted on a vertical shaft 27, a bifurcated horizontal arm 28 carried by the bracket 26 so that the arm 28 is vertically slidable on the bracket 26 by means of a rod and sleeve connection 29, and two pairs of suction pads 30 each pair carried by one of the two fingers 28*a* of the arm 28 so that the positions of the suction pads are horizontally adjustable along the fingers as well as to each other. A suitable known suction generator not shown supplies suction to the four suction pads 30 through flexible tubes 30*a*.

The vertical shaft 27 is rotatable about its own axis and vertically movable along its own axis by any suitable known mechanism shown as a mere block 31 in the machine housing 20 for simplicity of illustration so that the holder 23 mounted on the shaft 27 is accordingly vertically movable and at the same time horizontally swingable along a circular arc R as will be described later in detail.

The transfer head 8 is mounted on a vertical shaft 32 by means of an arm 33 and comprises a transfer pad 8*a* made of a resiliently deformable material such as silicone rubber and having a downwardly convex surface 8*b*. The pad 8*a* is connected to the outer end of the arm 33 by means of a support rod 34.

The shaft 32 is vertically movable along its own axis by any suitable known device such as an air cylinder shown as a mere block 35 in the housing 20 for simplicity of illustration so that the transfer head 8 is accordingly vertically movable as will be described later again.

The sheet stocker 25 stocks a plurality of sheets 1 of transfer material such as those prepared in accordance with the invention. The sheets 1 are piled up in the space defined by for upright adjustable members 25*a*.

The machine operates in the following manner. The sheet holder 23 is turned horizontally by turning the vertical shaft 27 clockwise in FIG. 6*b* as far as the suction pads 30 are positioned above the piled stock of the sheets of transfer material in the stocker 25, whereupon the shaft 27 is moved vertically downward as far as the pads 30 contact the uppermost one of the piled sheets of transfer material. Then suction is supplied to the pads 30, which sucks the uppermost sheet of transfer material and takes it up from the piled stock. With suction being continuously supplied, the holder 23 is raised and then turned horizontally in the opposite direction or counterclockwise in FIG. 6*b* as far as the held sheet 1' of transfer material is brought to the position just above the heating device 22, where the sheet holder with the sheet 1' is lowered onto the heating plate 22*a* kept at a suitable elevated temperature, say, between 80° and 200° C.

Figure 6C:
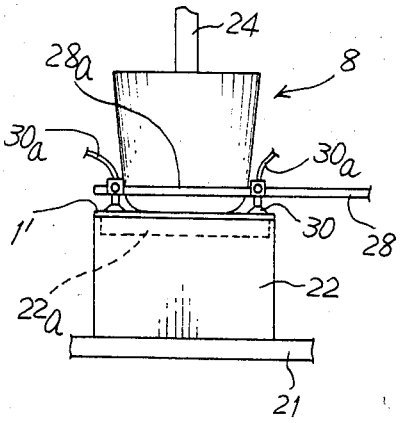
FIG. 6*c* is an enlarged elevational view of a portion of the machine of FIG. 6*a* shown in a different operative condition.

Then the transfer head 8 is lowered by moving the shaft 32 downwardly as far as the resiliently deformable pad 8*a* is pressed against the design layer of the heated sheet 1' of transfer material as shown in FIG. 6*c* so that as the head 8 is raised, the design layer with most of the thermoplastic layer of the sheet of transfer material is transferred to the pad surface of the transfer head, with the substrate and some of the thermoplastic material of the sheet being left on the heating plate. Then the sheet holder 23 is again turned clockwise in FIG. 6*b* passing over the sheet stocker 25 as far as a position beyond the edge of the top wall 21 of the machine housing 30, where the supply of suction to the pads is stopped so that the holder 23 releases the substrate of the sheet to gravitate into a receptacle 37.

An article 9 such as a piece of ceramic ware is then placed on the heating plate 22*a*, and the transfer head 8 with the design layer and the thermoplastic layer transfered to the pad surface and activated to continuous or persistent tackiness is lowered so as to be pressed against the surface of the ceramic ware, so that the design and thermoplastic layers are transfered from the pad surface to the ceramic surface. Then, the head 8 is again raised from the ceramic ware, which is then removed from the heating plate 22*a* for further processing, if necessary.

The above operation is repeated with a new sheet of transfer material picked up from the piled stock 1 in the sheet stocker 25 for the next article.

A suitable controller not shown may be provided for automatic synchronization of the movements of the sheet holder and the transfer head.

Figure 7A:
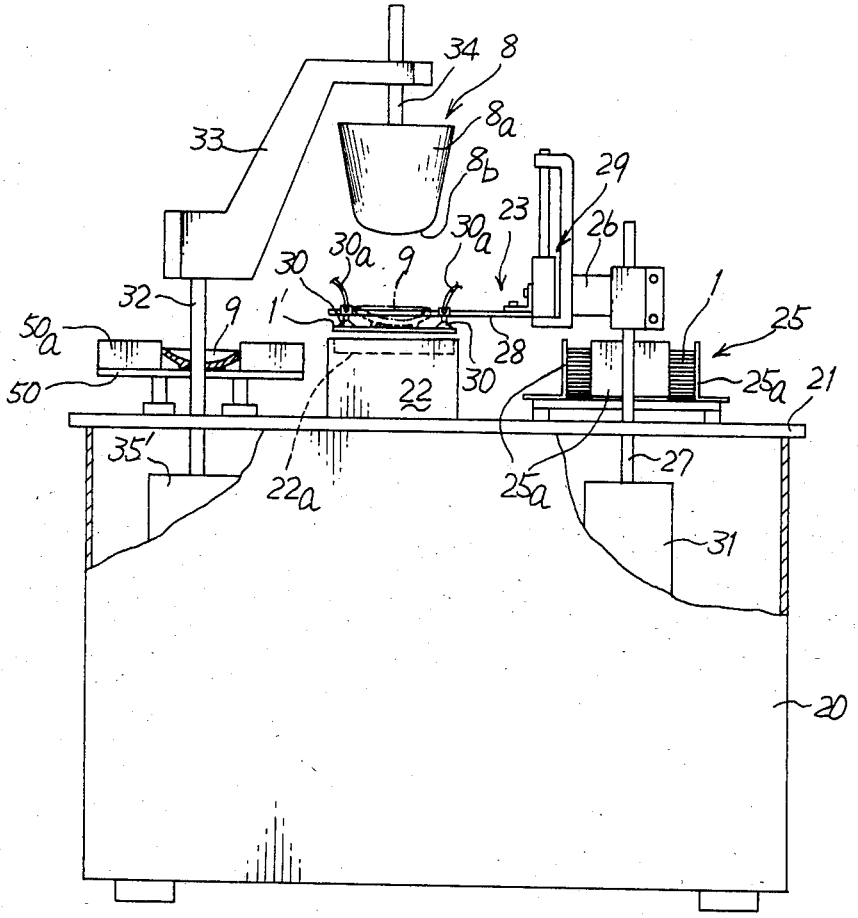
FIG. 7*a* is a view similar to FIG. 6*a* but showing another transfer printing machine of the invention.
Figure 7B:
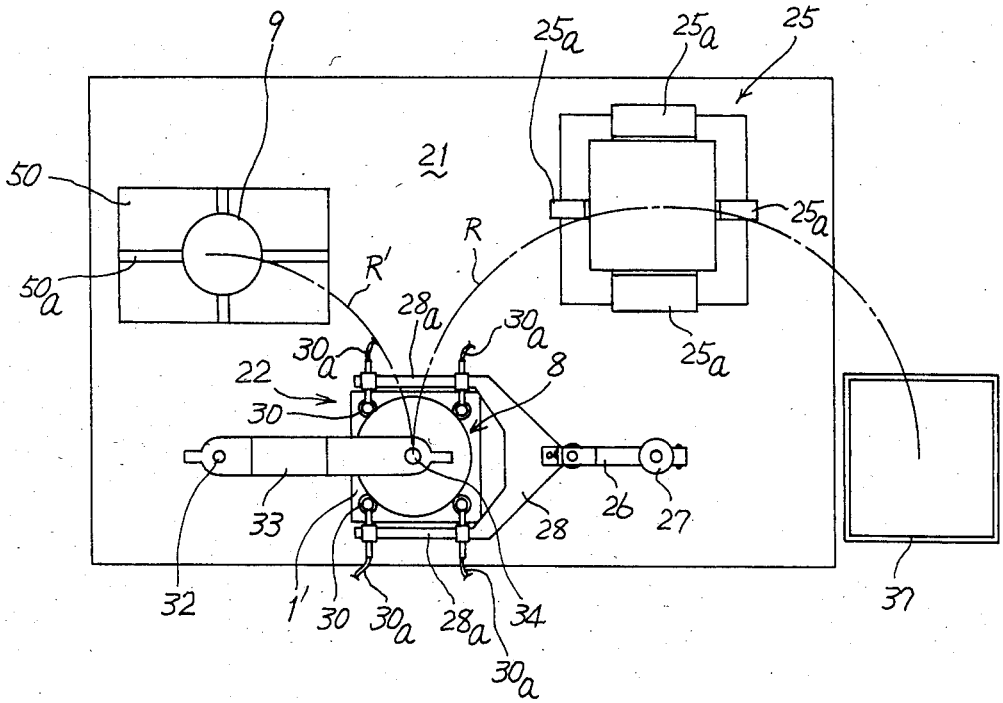
FIG. 7*b* is a top plan view of FIG. 7*a;*

Turning to FIGS. 7*a* and 7*b*, there is somewhat schematically shown a modified form of the machine shown is FIGS. 6*a* to 6*c*. In FIGS. 7*a* and 7*b*, the same reference symbols as in FIGS. 6*a* to 6*c* designate corresponding parts and devices. In this modified form, in addition to being vertically movable the shaft 32 is rotatable about its own axis so that the transfer head 8 can reciprocate along a circular arc R' between a first position above the heating plate 22*a* of the heating device 22 and a second position on the top wall of the machine housing, where a piece of ceramic ware 9 is to be placed so that the transfer head 8 with the design and thermoplastic layers transferred onto the pad surface thereof is pressed against the surface of the ceramic ware 9 for transfer of the design and thermoplastic layers from the pad surface to the ceramic ware surface. An article holder 50 holds the ware 9 fixedly by means of adjustable blocks 50*a*.

The mechanism for effecting the above-mentioned reciprocate turning of the transfer head as well as the vertical movement thereof can be of any suitable known type, which is shown as a mere block 35' in the machine housing 20 for simplicity of illustration.

Figure 8A:
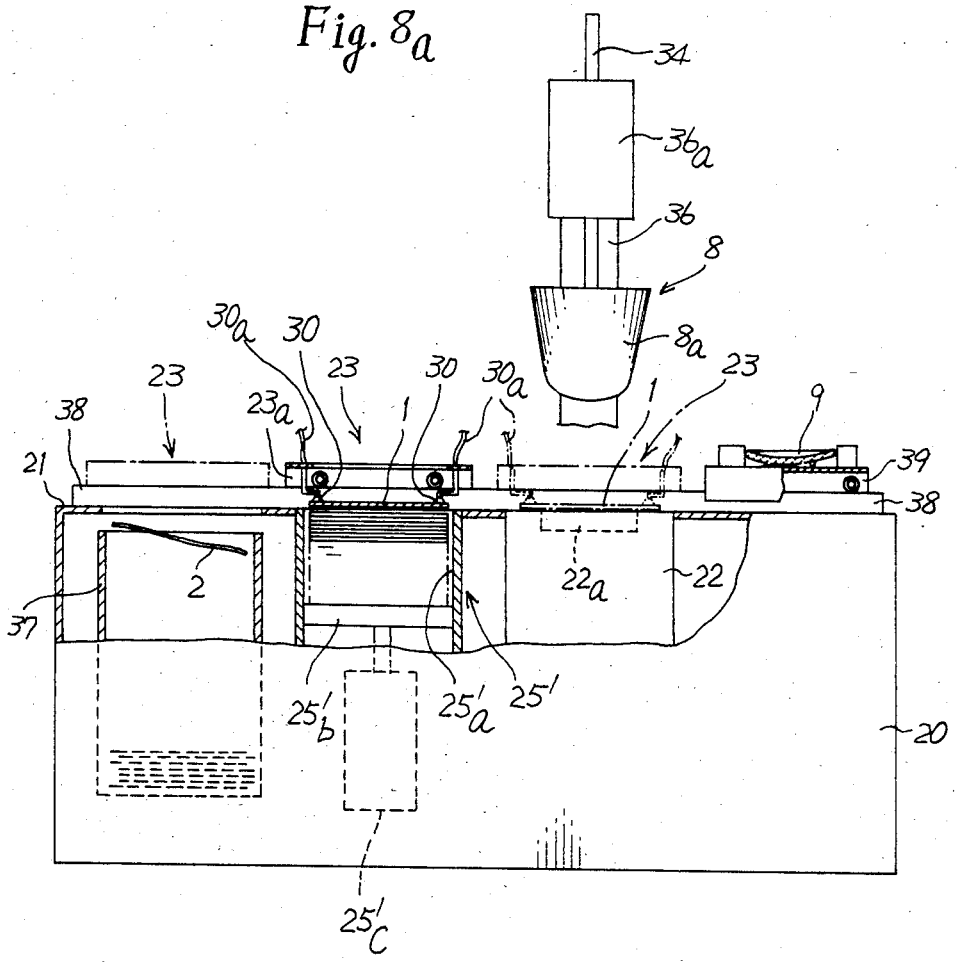
FIG. 8*a* is a view similar to FIG. 6*a* but showing a third transfer printing machine of the invention.
Figure 8B:
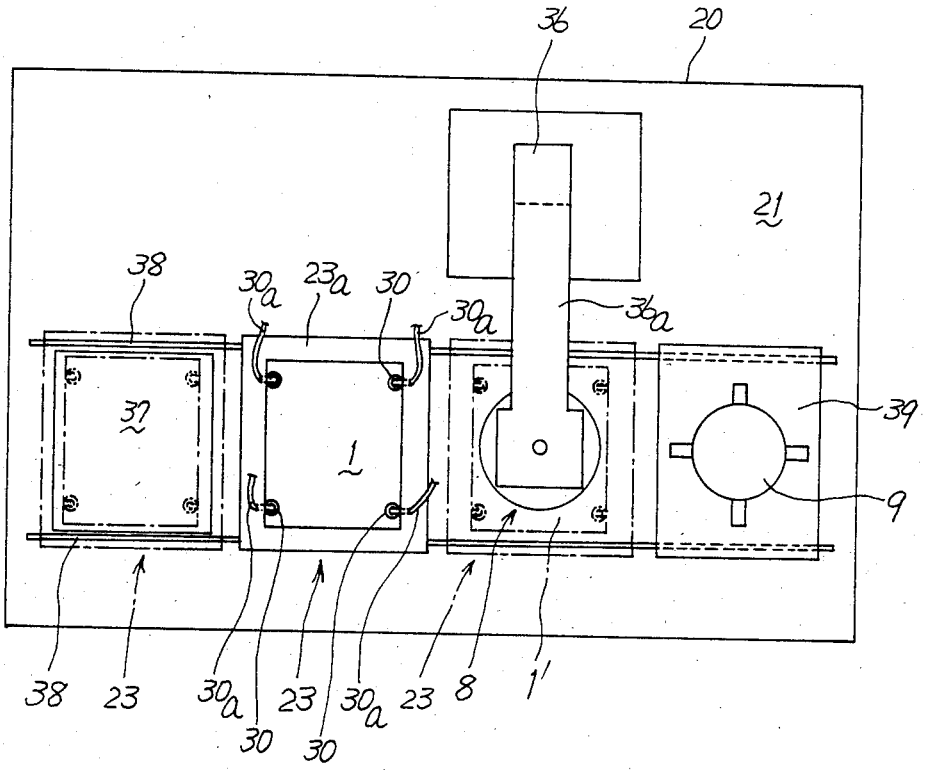
FIG. 8*b* is a top plan view of FIG. 8*a;*.

Another form of the machine is shown in FIGS. 8*a* and 8*b*, wherein the same reference symbols as in FIGS. 6*a* to 6*c* and 7*a* and 7*b* designate corresponding component parts and devices. The transfer head 8 is supported above the heating plate 22*a* by a support column 36 with an overhanging arm 36*a* so that the head 8 is vertically movable by means of a suitable known device not shown but enclosed in the arm 36*a* between a raised position and a lowered position where the deformable pad 8*a* of the transfer head 8 is pressed down against a sheet 1' of transfer material on the heating plate 22*a*.

The sheet stocker 25' comprises a recess 25'*a* having a bottom wall 25'*b* vertically movable by means of a suitable device such as an air cylinder schematically shown as a mere block 25'*c* for simplicity of illustration.

A stock of sheets 1 of transfer material as prepared in accordance with the invention are piled up on the bottom wall 25'*b* in the recess 25'*a*.

In the top wall of the machine housing 20 there is provided beside the sheet stocker 25' a receptacle 37 for receiving therein the substrates of the used sheets of transfer material. The sheet holder 23 has a carriage 23*a* slidably supported on a pair of parallel guide rails 38 laid horizontally on the top wall 21 of the machine housing 20 in such a manner that the carriage 23*a* carrying the sheet holder 23 can be positioned selectively at any one of the position above the heating plate 22*a*, the position above the sheet stocker 25' and the position above the waste paper receptacle 37.

Another carriage 39 for carrying thereon an article 9 to be colored is slidably supported on the guide rails 38 in such a manner that it can be selectively placed at the position above the heating plate 22*a* alternatively with the sheet holder 23 and at a lateral position beside the heating plate.

In operation, the sheet holder 23 is positioned above the sheet stocker 25', whereupon the bottom wall 25'*b* of the recess 25'*a* is raised by the device 25'*c* as far as the uppermost one 1 of the piled sheets of transfer material is contacted by the suction pads 30 of the holder 23, which takes up the sheet, carries it laterally onto the heating plate 22*a*, whereupon the transfer head 8 is lowered as far as its pad 8*a* is pressed against the heated sheet 1 on the heating plate 22*a* and then raised from the heating plate, with the design layer of the sheet of transfer material having been transferred to the pad surface.

The sheet holder 23 is moved from above the heating plate 22*a* laterally in the opposite direction as far as above the waste paper receptable 37, where the holder 23 releases the substrate 2 of the used sheet of transfer material into the receptacle 37.

When the sheet holder 23*a* has been removed from above the heating plate 22*a*, the carriage 39 on which a piece of ceramic ware 9 is placed is moved to a position above the heating plate 22*a* or just below the raised head 8, whereupon the head 8 is lowered as far down as the pad 8*a* is pressed against the upper surface of the article 9 so that the design layer and the thermoplastic or adhesive layer are transferred from the pad surface to the surface of the article as the head is again raised. The carriage 39 is then removed laterally from above the heating plate to the original position.

Figure 9:
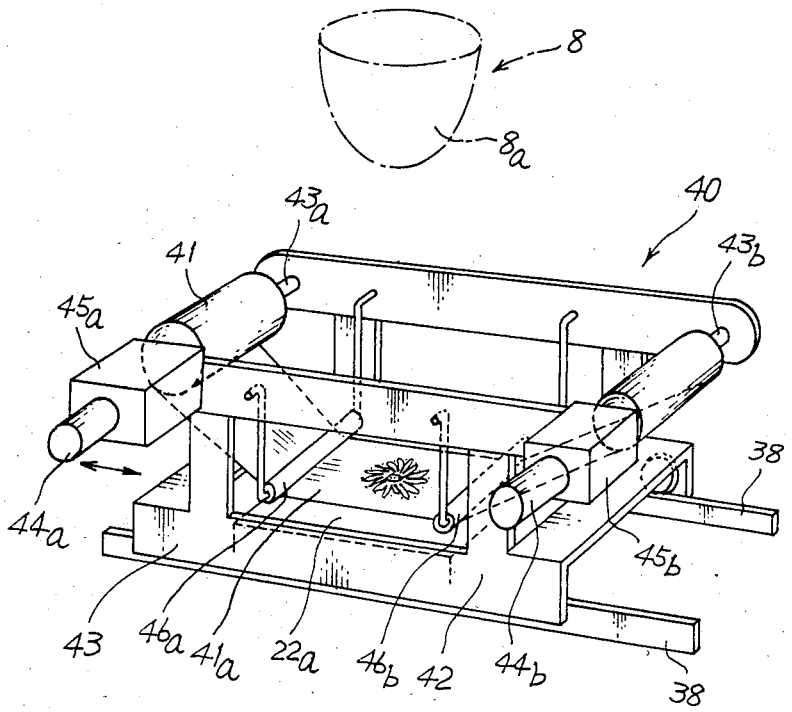
FIG. 9 is a perspective view of a device used in the machine of the invention.

The sheet holder 23 and the sheet stocker 25' in FIGS. 8*a* and 8*b* may be replaced by a single device 40 as shown in FIG. 9. The device 40 holds a roll 41 of a continuous sheet comprising a plurality of successive sections 41*a* of transfer material and supplies one of the sections after another to the heating plate 22*a* of the heating device 22. The device 40 comprises a carriage 42 movable on the rails 38 as in FIGS. 8*a* and 8*b* and a pair of shafts 43*a* and 43*b* which are rotated by motors 44*a* and 44*b* through reduction gears 45*a* and 45*b*, respectively.

The roll 41 of transfer material is mounted on one of the shafts, say 43*a*, and the motors 44*a* and 44*b* are so energized that the sheet of transfer material is withdrawn one section at a time from the roll 41 for use in transfer printing and wound onto the other shaft 43*b* after the transfer printing with each section has been finished. The sheet of transfer material is guided by a pair of swingable tension rollers 46*a* and 46*b*.

With a new section 41*a* withdrawn from the rolled sheet 41 and positioned between the two tension rollers 46*a* and 46*b*, the device 40 is moved on the rails 38 so that the section 41*a* of the sheet of transfer material is positioned immediately above the heating plate 22*a* of the heating device 22 and below the transfer head 8. Then the head 8 is lowered as far as the pad 8*a* is pressed against the section 41*a* of transfer material on the heating plate 22*a* so that the design layer and the thermoplastic layer of the sheet section 41*a* are transferred to the surface of the pad 8*a*. The head 8 is then raised from the sheet section 41*a* with the transferred layers on the pad surface.

The device 40 is then removed from above the heating plate 22*a*, and instead the carriage 39 carrying an article to be treated is moved on the rails 38 to be positioned just below the transfer head 8, which is lowered as far down as the pad 8*a* is pressed against the surface of the article, so that the design layer and the thermoplastic layer are transferred from the pad surface to the surface of the article as the head is raised therefrom.

Meanwhile, the motors 44*a* and 44*b* on the device 40 are energized to wind the used section of the sheet of transfer material and simultaneously withdraw a new section of the sheet ready for the next transfer printing operation.

It is required that the stroke of the head when it is lowered into contact with the sheet of transfer material on the heating plate should be different from that when the head is lowered into contact with the surface of an article on the carriage to provide a proper contact pressure between the pad and the sheet or the surface of the article. To meet the requirement, any suitable device may be provided to enable automatic cyclic control of the stroke of the head.

According to the invention, it is the transfer material alone that must be heated and it is not necessary to keep heated the transfer material and the article to be transfer-printed during the printing process. This eliminates complicated temperature control and simplifies the whole process and the construction of the apparatus with resulting decrease in the manufacturing and energy cost.

What I claim is:

1. A method of coloring the surface of an object comprising a first step of providing a sheet of transfer material consisting essentially of a substrate, a layer of thermoplastic material formed on said substrate, and a design layer formed on said layer of thermoplastic material, said thermoplastic material being heat-sensitive and characterized in being non-tacky at room temperatures, further characterized by being activated upon being heated and remaining activated for a predetermined period of time after termination of said heating, solidifying to effect complete adhesion upon lapse of said predetermined period of time;

a second step of heating said sheet to a temperature at which said thermoplastic layer becomes tacky, and a third step of transferring said design layer from said sheet to the surface of said object;

said transferring step comprising pressing a transfer pad against said design layer of said sheet of transfer material so that said design layer and said thermoplastic layer are transferred to the surface of said pad, and then pressing said pad surface with said transferred layers thereon against the surface of said object so that said design and thermoplastic layers are transferred from said pad surface to said surface of said object.

2. The method of claim 1, wherein said thermoplastic layer of said sheet of transfer material is of a material decomposable when heated above the temperature at which said thermoplastic material is activated, and said design layer comprises an ink used for coloring ceramic ware.

3. The method of claim 2, wherein said object is of a heat-resistive material, and further including a fourth step of heating said object to a temperature at which said thermoplastic material is decomposed, thereby to remove the burned remnants from the surface of said object.

4. The method of claim 3, wherein said heat-resistive material is selected from the group consisting of glass, ceramic and metal.

5. The method of claim 4, wherein said object is a piece of glazed ceramic ware.

6. The method of claim 4, wherein said object is a piece of unglazed ceramic ware coated with glaze, and further including a fourth step of firing said piece of ceramic ware having a coating of glaze and said thermoplastic layer on said coating of glaze.

7. The method of claim 1, wherein said sheet of transfer material further includes a layer of wax-like material disposed between said substrate and said thermoplastic layer, said wax-like material having a softening point substantially equal to the temperature at which said thermoplastic material is activated.

8. The method of claim 1, wherein said sheet of transfer material further includes a coating layer protecting said design layer from distortion or damage.

9. The method of claim 1, wherein said second step of heating is conducted by placing said sheet of transfer material on a heating member.

10. The method of claim 1, wherein said second step of heating is conducted by bringing said transfer pad previously heated into contact with said sheet of transfer material.

11. The method of claim 1, wherein said transfer pad is of a resiliently deformable material and said object has a curved surface, against which said pad with said design and thermoplastic layers is pressed.

* * * * *